US007551164B2

(12) United States Patent
Deane

(10) Patent No.: US 7,551,164 B2
(45) Date of Patent: Jun. 23, 2009

(54) ACTIVE MATRIX OLED DISPLAY DEVICE WITH THRESHOLD VOLTAGE DRIFT COMPENSATION

(75) Inventor: Steven C. Deane, Redhill (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 690 days.

(21) Appl. No.: 10/554,845

(22) PCT Filed: Apr. 20, 2004

(86) PCT No.: PCT/IB2004/001362

§ 371 (c)(1),
(2), (4) Date: Oct. 28, 2005

(87) PCT Pub. No.: WO2004/097782

PCT Pub. Date: Nov. 11, 2004

(65) Prior Publication Data

US 2006/0208971 A1 Sep. 21, 2006

(30) Foreign Application Priority Data

May 2, 2003 (GB) ..... 0310109.4

(51) Int. Cl.
*G09G 5/00* (2006.01)

(52) U.S. Cl. ..... 345/204; 345/76; 345/77; 345/82; 345/209; 345/690; 313/500; 313/504; 315/169.1; 315/169.3

(58) Field of Classification Search ..... 345/76, 345/77, 82, 204, 209, 690; 313/500, 504; 315/169.1, 169.3
See application file for complete search history.

(56) References Cited

U.S. PATENT DOCUMENTS 5,903,246 A 5/1999 Dingwall
6,229,508 B1 5/2001 Kane
6,271,823 B1 8/2001 Gordon, II et al.
6,445,323 B1 9/2002 Cairns et al.
6,498,438 B1 * 12/2002 Edwards ..... 315/169.3
6,531,997 B1 3/2003 Gates et al.
7,205,966 B2 * 4/2007 Numao ..... 345/76
7,443,367 B2 * 10/2008 Numao ..... 345/76
2001/0024186 A1 9/2001 Kane et al.

(Continued)

FOREIGN PATENT DOCUMENTS

EP 0717446 A2 6/1996
EP 0905673 A1 3/1999
EP 1191512 A2 3/2002
WO 9636959 A2 11/1996

*Primary Examiner*—Bipin Shalwala
*Assistant Examiner*—Vince E Kovalick

(57) ABSTRACT

An active matrix display device has an array of oled display pixels (2) operable in two modes in which the power supply line (26) is modulated between a low voltage and a normal power supply voltage. In a first mode, a pixel drive transistor current is supplied to the display element (2) and is selected to provide a desired pixel brightness. In a second mode, a voltage is provided to the drive transistor and is selected to provide a desired ageing effect, but no current flows through the display element. The frame time is thus divided into two periods, one when the power supply line (26) is supplied with a voltage of e.g. OV or −5V to turn the display element on and the other when the power supply line (26) is supplied with a voltage of e.g. OV or −5V to turn the display element off. During the off period, a voltage is nevertheless applied to the drive transistor, and this voltage is selected so that the overall threshold voltage drift in the drive transistor for all pixels (resulting from ageing) is substantially the same.

19 Claims, 7 Drawing Sheets

U.S. PATENT DOCUMENTS

2001/0052597 A1* 12/2001 Young et al. ..... 257/59
2002/0021293 A1* 2/2002 Tam ..... 345/204
2002/0175885 A1 11/2002 Cok
2002/0180688 A1 12/2002 Drzaic et al.
2002/0195968 A1 12/2002 Sanford et al.
2003/0052614 A1 3/2003 Howard
2003/0117348 A1* 6/2003 Knapp et al. ..... 345/76
2005/0180083 A1* 8/2005 Takahara et al. ..... 361/152

* cited by examiner

ACTIVE MATRIX OLED DISPLAY DEVICE WITH THRESHOLD VOLTAGE DRIFT COMPENSATION

This invention relates to active matrix display devices, particularly but not exclusively active matrix electroluminescent display devices having thin film switching transistors associated with each pixel.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, a vacuum evaporation/sublimation process, or simply by a spin coating technique using a solution of a soluble conjugated polymer. Ink-jet printing may also be used. Organic electroluminescent materials can be arranged to exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase.

FIG. 1 shows a known pixel circuit for an active matrix addressed electroluminescent display device. The display device comprises a panel having a row and column matrix array of regularly-spaced pixels, denoted by the blocks 1 and comprising electroluminescent (EL) display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as indium tin oxide (ITO) so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used. Opaque substrates can also be used, such as a metal foil with an insulating layer, and light is then emitted away from the substrate, for example through a transparent top electrode.

FIG. 2 shows in simplified schematic form a known pixel and drive circuitry arrangement for providing voltage-addressed operation. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 in this circuit is implemented as a p-type TFT, and the storage capacitor 24 holds the gate-source voltage fixed. This results in a fixed source-drain current through the transistor, which therefore provides the desired current source operation of the pixel. The p-type drive transistor can be implemented using low temperature polysilicon. The drive transistor can be implemented as n-type transistor (with appropriate modification to the circuit), and this will normally be appropriate for implementation using amorphous silicon.

In the above basic pixel circuit, for circuits based on polysilicon, there are variations in the threshold voltage of the transistors due to the statistical distribution of the polysilicon grains in the channel of the transistors. Polysilicon transistors are, however, fairly stable under current and voltage stress, so that the threshold voltages remain substantially constant.

There is much interest in implementing amorphous silicon pixel circuits for active matrix LED displays. This is becoming possible as the electrical current requirements for the LED devices are reducing with improved efficiency devices. For example, organic LED devices and solution processed organic LED devices have recently shown extremely high efficiencies through the use of phosphorescence. The variation in threshold voltage is small in amorphous silicon transistors, at least over short ranges over the substrate, but the threshold voltage is very sensitive to voltage stress. Application of the high voltages above threshold needed for the drive transistor causes large changes in threshold voltage, which changes are dependent on the information content of the displayed image. This ageing is a serious problem in LED displays driven with amorphous silicon transistors.

There have been a number of proposals for voltage-addressed pixel circuits which compensate for changes in the threshold voltages of the drive transistors used resulting from ageing. Some of these proposals introduce additional circuit elements into each pixel so that the threshold voltage of the drive transistor can be measured, typically every frame. One way to measure the threshold voltage is to switch on the drive transistor as part of the addressing sequence, and to isolate the drive transistor in such a way that the drive transistor current discharges a capacitor across the gate-source junction of the drive transistor. At a certain point in time, the capacitor is discharged to the point where it holds the threshold voltage of the drive transistor, and the drive transistor stops conducting. The threshold voltage is then stored (i.e. measured) on the capacitor. This threshold voltage can then be added to a data input voltage (again using circuit elements within the pixel) so that the gate voltage provided to the drive transistor takes into account the threshold voltage.

These compensation schemes require more complicated pixel configurations and drive schemes.

According to the invention, there is provided an active matrix display device comprising an array of display pixels, each pixel comprising a current-driven light emitting display element and a drive transistor for driving a current through the display element, wherein each pixel is operable in two modes; a first mode in which the drive transistor current is supplied to the display element and is selected to provide a desired pixel brightness, and a second mode in which a voltage is provided to the drive transistor and is selected to provide a desired ageing effect, and no current flows through the display element.

In this device, the frame time is divided into two periods, one when the display element is on and the other when the display element is off. During the off period, a voltage is nevertheless applied to the drive transistor, and this voltage is selected so that the overall threshold voltage drift in the drive transistor for all pixels (resulting from ageing) is substantially the same.

The voltage provided to the drive transistor in the second mode is a gate-source voltage. The drift in the threshold voltage is dependent on the gate-source voltage rather than the current driven. Thus, the pixel can be arranged in the second mode to provide no drive current but have the gate-source voltage across the drive transistor.

Each pixel is preferably operated in the two modes for each frame of image data. For example, the first and second modes may be equal in duration. It has previously been recognised that a discontinuous drive scheme improves rendition of moving images.

The drive transistor and the display element are preferably connected in series between a high power supply line and a low power supply line. The voltage on the high power supply line is preferably switchable so that different voltages are applied to the high power supply line for the two modes of operation. In this way, the power supply line voltage is used to ensure that no current flows through the display element in the second mode.

A second drive transistor may be provided in parallel with the drive transistor for selectively bypassing the display element. This acts as a bypass but also ensures that the display element voltage (the anode voltage) is well defined during pixel programming. An address transistor may also be provided between a data supply line and the gate of the drive transistor, and the address transistor and the second drive transistor can be controlled by a shared control line.

In one embodiment, the display pixels are within a display area, and the device further comprises at least one modelling circuit outside the display area for modelling the behaviour of a plurality of the display pixels and comprising a current-driven light emitting display element and a drive transistor, the at least one modelling circuit being provided with a pixel drive signal derived from the pixel drive signals for the plurality of display pixels. The device then further comprises:

means for measuring a transistor characteristic of the drive transistor of the modelling circuit; and means for modifying the pixel drive signals for the plurality of display pixels in response to the measured transistor characteristic.

In this embodiment, a dummy pixel (or pixels) is used to model the ageing of the pixels of the display, and an appropriate correction is made to the pixel drive signals. As the ageing of the pixels has been made uniform, it is possible to correct for this with simple modification to the pixel circuit and timing. The transistor characteristic may be the transistor threshold voltage. The analysis of the dummy pixel is essentially to enable the gate source voltage necessary for the generation of a given current or currents to be determined. Thus, the modelling can take account of other variations in the transistors, for example variations in mobility.

A single modelling circuit can be for modelling the behaviour of all of the display pixels, as the ageing is made uniform by the device of the invention. However, if desired a plurality of modelling circuits can be provided, each for modelling the behaviour of a respective sub-set of the display pixels.

The pixel drive signal provided to the modelling circuit is derived from the combined signal (i.e. the combination of the first and second modes) for the pixel drive signals. If the invention does not provide complete uniformity in the ageing of pixels, an average value may be used as the input to the pixel modelling circuit. If an averaging operation is carried out, it can be obtained by averaging the digital image data (available in the column driver circuit) for the corresponding plurality of display pixels or by averaging the drive current supplied to the corresponding plurality of display pixels. In this case, circuitry for measuring the current supplied to the display is required.

The modelling circuit may for example comprise a scaled version of a pixel circuit of the display. This circuit is already provided for other testing purposes.

The pixel drive signals can be modified in the column driver circuitry. However, the pixel drive signals for the plurality of display pixels can instead be modified using additional circuitry within each display pixel. For example, and as shown in FIG. 2, a storage capacitor is typically provided between the gate and source of the drive transistor and an address transistor is provided between a column data line and the gate of the drive transistor. Additional circuitry can then be provided in the form of a second address transistor between a second column line and the source of the drive transistor. In this way, the storage capacitor holds a gate source voltage which depends both on the pixel data input and the data on the second column line.

Instead, the additional circuitry may comprise a second storage capacitor, the first and second storage capacitors being in series between the gate and source of the drive transistor. In this arrangement, one capacitor is for the data signal and the other is for the threshold voltage.

The invention also provides a method of driving an active matrix display device comprising an array of display pixels, each pixel comprising a current-driven light emitting display element and a drive transistor for driving a current through the display element, the method comprising:

in a first mode, providing a first gate-source voltage to the drive transistor and supplying the resulting current to the display element; and in a second mode, providing a second gate source voltage to the drive transistor, the second gate source voltage being selected to provide a desired ageing effect, and wherein no current flows through the display element during the second mode.

This method uses an on mode to drive pixel data to the display element and uses an off mode to equalise the ageing of all pixels.

The second mode may be carried out before the first mode, and the first and second modes are carried out for each addressing of each pixel. For example, the second mode may be immediately before an addressing phase during which the first gate source voltage is provided to the drive transistor.

Although the pixels will age by a substantially constant amount, there will be a change in the drive transistor characteristics over time. A modelling circuit may be provided outside the display area for modelling the behaviour of a plurality of the display pixels and comprising a current-driven light emitting display element and a drive transistor. The method then includes:

providing the at least one modelling circuit being with a pixel drive signal derived from the pixel drive signals for the plurality of display pixels;

measuring a transistor characteristic of the drive transistor of the modelling circuit; and modifying the pixel drive signals for the plurality of display pixels in response to the measured transistor characteristic.

The invention will now be described by way of example with reference to the accompanying drawings, in which.

Figure 1:
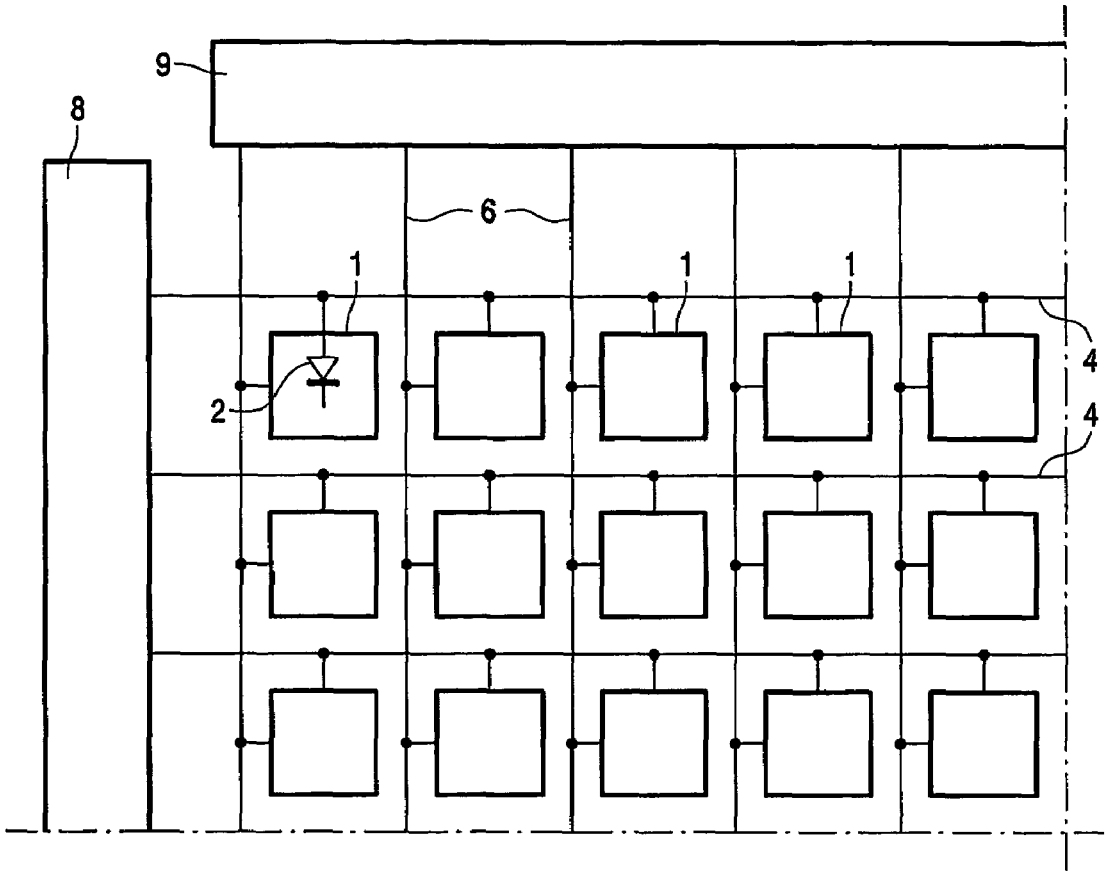
FIG.1 PRIOR ART
FIG. 1 shows a known EL display device.

It should be noted that these figures are diagrammatic and not drawn to scale. Relative dimensions and proportions of parts of these figures have been shown exaggerated or reduced in size, for the sake of clarity and convenience in the drawings.

The invention provides a pixel configuration and drive scheme in which each pixel is operable in two modes; a first mode in which the drive transistor current is supplied to the display element and is selected to provide a desired pixel brightness, and a second mode in which a voltage is provided to the drive transistor and is selected to provide a desired ageing effect.

Figure 2:
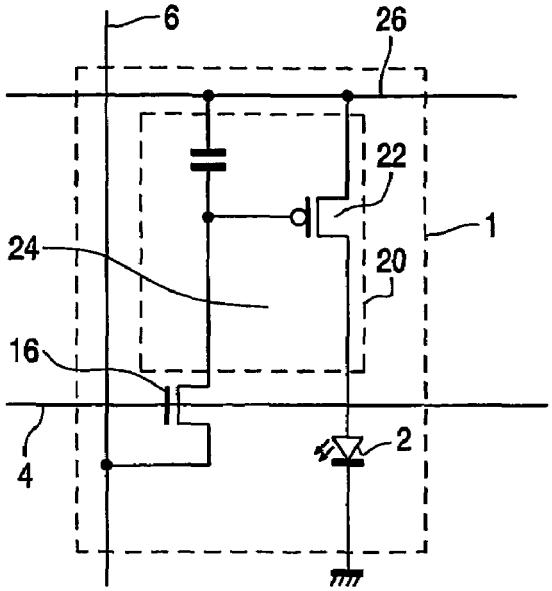
FIG.2 PRIOR ART
FIG. 2 is a simplified schematic diagram of a known pixel circuit for current-addressing the EL display pixel.
Figure 3:
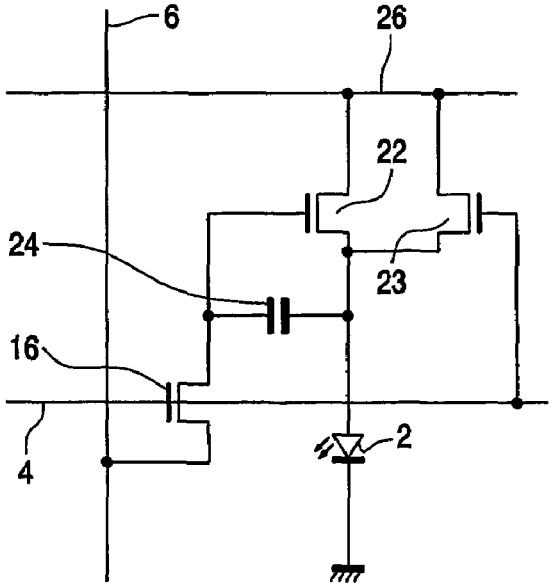
FIG. 3 is a schematic diagram of a pixel circuit of the invention.

The most basic pixel circuit is shown in FIG. 3. The pixel circuit corresponds to that of FIG. 2, but has an additional drive transistor 23 connected in parallel with the drive transistor 22. Thus, the additional drive transistor 23 is connected between the power supply line 26 and the source of the first drive transistor 22. The additional drive transistor can be used to couple the source of the drive transistor 22 to the power supply line. This enables the anode voltage (which corresponds to the first drive transistor source voltage) to be well defined during pixel programming. The second drive transistor is gated with the same control signal as the address transistor 16. The power supply line has a switchable voltage applied to it, and the second drive transistor 23 can be used to ensure the display element is turned off, as will become apparent from the following.

It should be noted that the invention does not necessarily require an additional transistor in the pixel circuit. Indeed, a simpler two-transistor circuit is possible if a gate-drain voltage is stored between the power line and the gate of the drive transistor 22. In this case, the additional drive transistor 23 is no longer required. However a circuit of this type will be susceptible to current changes via changes in the display device anode voltage through ageing and heating and voltage drops in the power line. Therefore the more controllable three transistor circuit shown in FIG. 3 is preferred.

This circuit requires the power supply line to be modulated between a low voltage (e.g. 0V or −5V) and the normal power supply voltage (e.g. 15V). When the circuit is addressed by the transistor 16, the power line is brought down to the low voltage. This stops current flowing through the drive transistor 22, so that the power line 26 then provides a good reference level (for example ground or −5V) to reference the data voltage supplied by the column 6 through the second drive transistor 23. Once the capacitor 24 is charged, the address line goes low and after this the power line is brought high. Current starts to flow and the anode of the display element and the gate of the drive transistor 22 float up to their respective operating positions.

Figure 4:
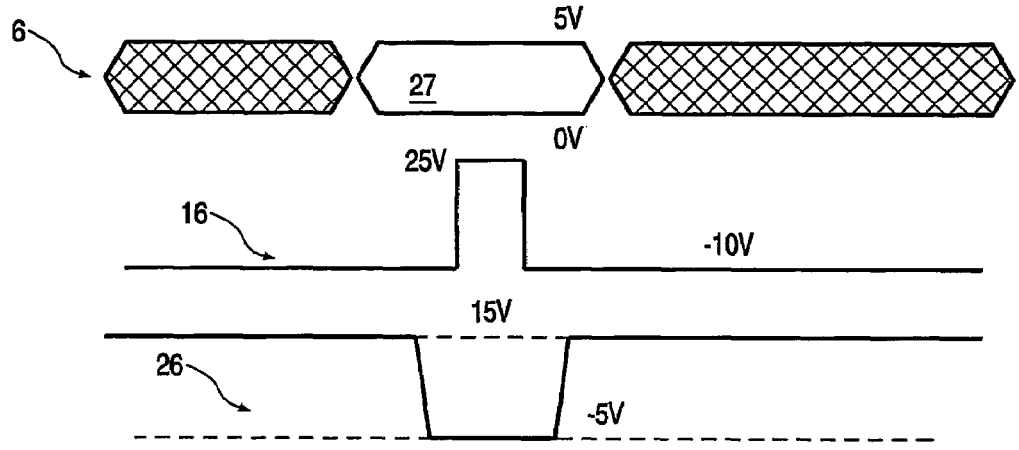
FIG. 4 is a first timing diagram for explaining the operation of the pixel circuit of FIG. 3.

FIG. 4 shows how the circuit of FIG. 3 requires certain timing conditions for the row address pulse and the switching of the power supply line voltage. As shown, the power supply line 26 goes low before the address line (referenced 16 in FIG. 4) has gone high to avoid current flowing through the second drive transistor 23 to the display element. If the power is allowed to go low after the address line has gone high, then a flash of light is emitted, degrading the dark state of the display. The power supply line 26 goes high after the address pulse has ended. Data to be stored on the storage capacitor 24 is provided on the column 6 during the clear part 27 of the plot 6.

The invention makes use of the fact that the drift in the drive transistor threshold voltage is driven by the source-gate voltage, not the current passed. Thus, while the power line is low, it is possible to address the circuit with any data, and no image is seen. By choosing the data appropriately, the threshold voltage drift in the time when the image is displayed (power high) and the threshold voltage drift in the time when it is not (power low) always sum to a constant amount. Thus, no image-dependant drift occurs.

In order to provide two drive levels for the drive transistor, each line must be addressed twice per frame. Light is emitted for only for one period (for example half the time), but this is desirable in any case to improve motion perception.

Figure 5:
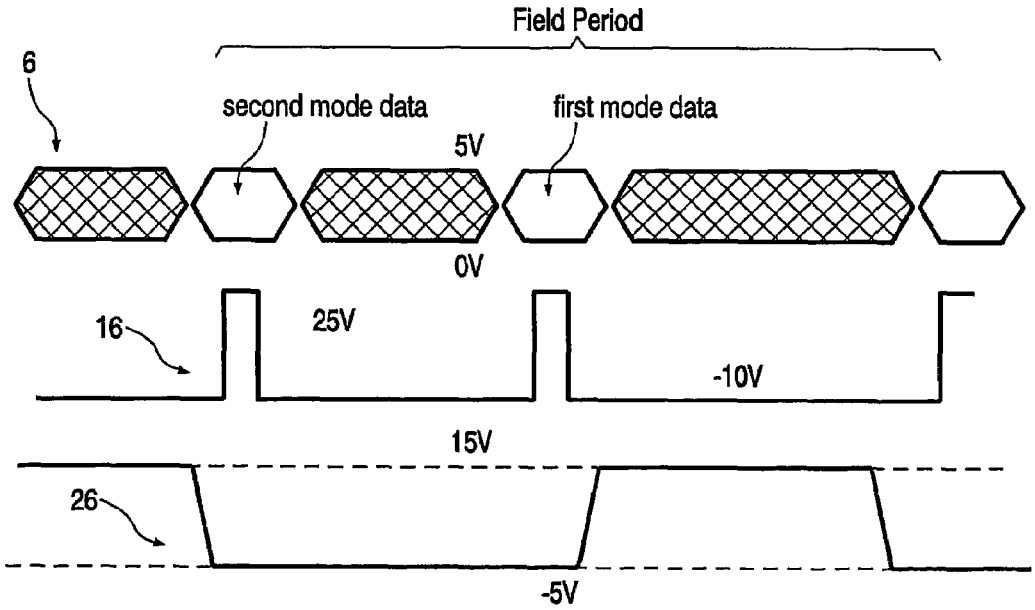
FIG. 5 is a second timing diagram for explaining the operation of the pixel circuit of FIG. 3.

FIG. 5 shows one possible timing scheme in accordance with the invention.

As shown, there are two address pulses (the high pulses in the address line 16) within the frame period. During the initial part of the frame period, the display element is turned off by the low power line. In the first address pulse, a gate-source voltage is provided on the column 6 to provide the desired ageing of the drive transistor 22. This is referenced "second mode data". This may be calculated based on the data to be supplied to the pixel in the latter part of the frame (requiring previous knowledge of the data to be supplied to the pixel), or else based on the pixel data supplied to the pixel in the previous frame. In either case, the drive transistor of each pixel is subjected to the same overall ageing conditions over each full field period. A frame store will be required to enable calculation of the "second mode data".

In the second address pulse, the data supplied to the column is changed to the desired pixel output data, referenced "first mode data".

For each address pulse, the data is applied only for a duration sufficient to charge the storage capacitor 24, for example 20 microseconds for a 20 millisecond frame period. Thus, the proportion of the frame time taken up by the two address pulses is exaggerated in FIG. 5.

Within the field period, the first mode data may of course precede or follow the second mode data.

This approach provides uniform ageing of the transistor characteristics, regardless of the image data being displayed. However, the threshold voltage of the drive transistor 22 for each pixel will drift, so that the current through the transistor will drop. Therefore images displayed could quickly show so-called "burn-in" artifacts.

However, as the threshold voltage drift is uniform across the display, it is easily corrected. In particular, the overall drift can be monitored in test circuits at the edge of the display, and compensated for uniformly in a number of ways.

Figure 6:
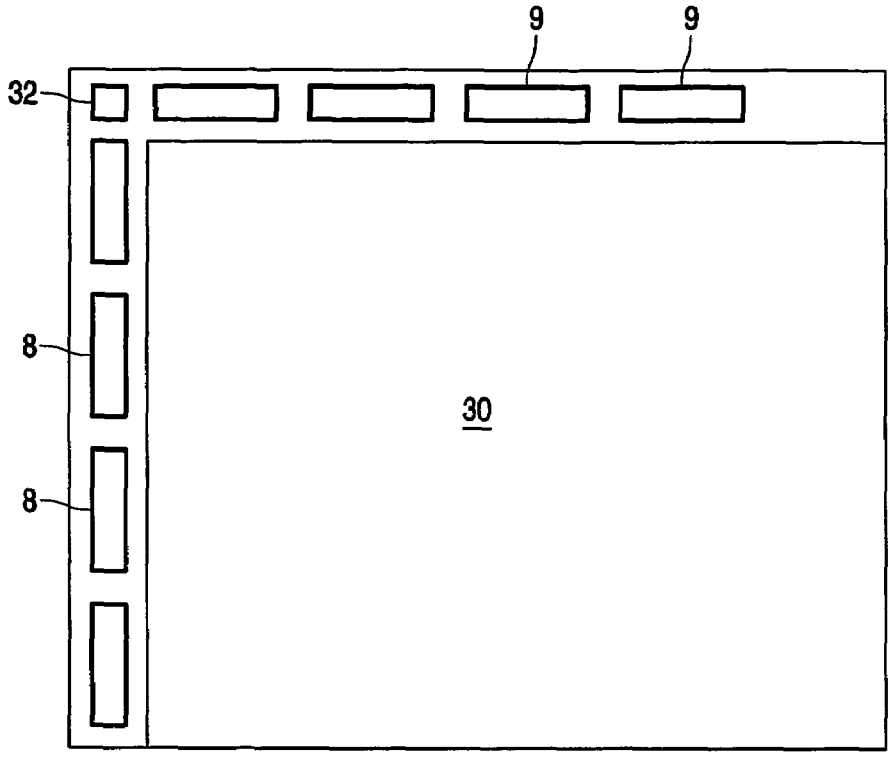
FIG. 6 shows how the invention may use additional circuitry outside the display area.

FIG. 6 shows a display which comprises a display area 30, and row and column driver circuits 8, 9 outside the display area. A test unit 32 is provided, in the form of one or more dummy pixels. These additional pixels, outside the display area 30, are often already provided for testing purposes and are frequently termed Process Control Modules or Test Circuits.

Figure 7:
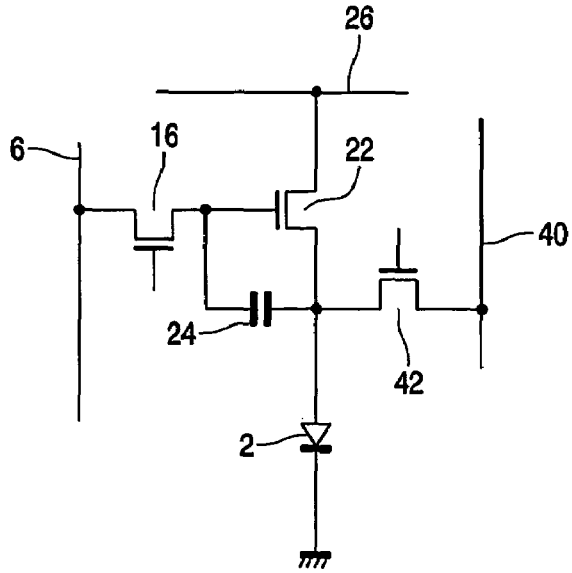
FIG. 7 shows a circuit used within the device of FIG. 6.

FIG. 7 shows one possible example of the dummy pixel design for modelling the behaviour of the pixel circuit of FIG. 3. The circuit elements 2, 22, 24 of the dummy pixel may replicate those in the pixels, or else the dummy circuit may comprise a scaled version of the pixel circuit. Thus, the dummy circuit may comprise the parallel connection of several pixels so that the circuit behaves in the same way as the pixel circuit but has larger currents flowing for the same voltages. This is easier to measure than a single pixel circuit.

Alternatively, the circuit components can be physically larger, although with all circuit components increased in size by the same factor. The important point is that the circuit behaves in the same way as a pixel circuit. In all cases, the dummy pixel circuit represents the actual pixel circuit with similar components and operation to ensure accurate correction. The dummy pixel circuit does not need to include transistor 23, as long as the sense transistor 42 (discussed below) replaces the function of the second drive transistor 23 of ensuring that the display element anode is at a known voltage during pixel programming. The ageing of the drive transistor 22 can be modelled based only on the gate-source voltage applied to the transistor. This gate-source voltage will be based on the uniform average ageing conditions to which all pixels in the display are subjected by virtue of the invention.

The dummy pixel circuit includes an additional sense line 40 and a sense transistor 42 connected between the sense line 40 and the source of the drive transistor 22. The dummy circuit is then used to measure the drive transistor threshold voltage.

Figure 8:
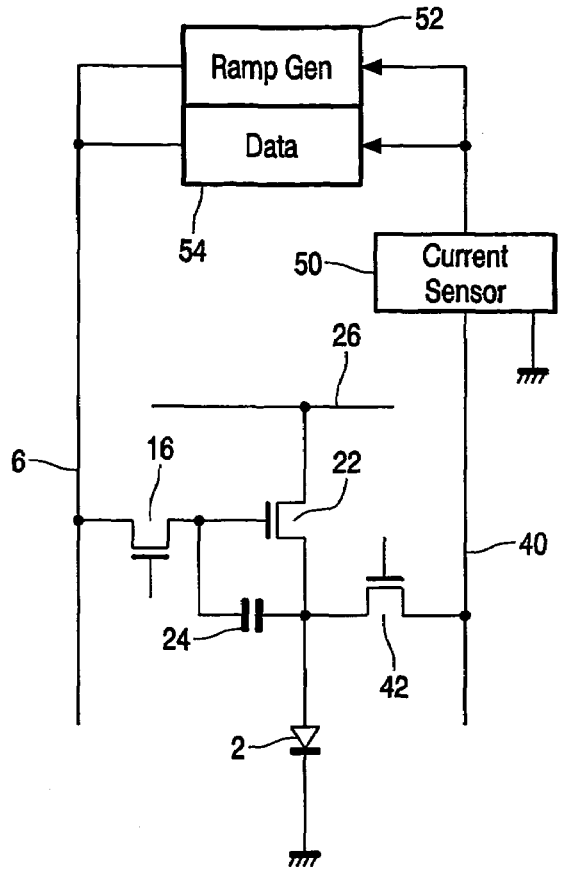
FIG. 8 shows measurement circuitry associated with the circuit of FIG. 7.

For measuring the drive transistor threshold voltage, the sense line 40 is connected to a virtual earth current sensor 50, shown in FIG. 8. This device measures current without allowing any change in the voltage on the sense line 40, so that very small currents can be sensed. The current sensor controls the operation of a ramp voltage generator 52.

At the start of each field period of the display, the dummy pixel circuit is used to carry out a threshold voltage measurement operation. During the remainder of the field period, the dummy circuit is driven to a voltage to represent the drive conditions of the pixels of the array.

For the threshold measurement operation, address transistor 16 and the sense transistor 42 are turned on. The gate of the drive transistor 22 is then discharged to the voltage on the data column 6 which at that time is arranged to be less than the threshold voltage of the drive transistor 22, so that it is turned off. The anode of the LED display element 2 is also held at the voltage of the sense line 40, which is ground. The power rail 26 is high.

The ramp generator 52 then increases the voltage on the column 6, either linearly or in stepwise manner, for example by increasing the voltage output of a buffer, or by injecting charge to the column. The gate of the drive transistor 22 follows the column voltage until the drive transistor turns on, and current is then injected to the sense line 40 and is detected by the current sensor 42. At this time, the voltage output of the ramp generator is stored and is used as a measure of the threshold voltage of the drive transistor.

During the remainder of the field period, a signal is provided to the dummy pixel from the data source 54. During this time, the dummy pixel is driven with a signal representing the uniform average drive conditions of the entire array of pixels.

The dummy pixel is driven with this average gate source voltage value, or else with a scaled version of this, depending on the circuit components in the dummy pixel. The threshold voltage measurement may be once in each field period, but it may be more or less frequent. The timing is such that each adjustment is small, and the adjustment is preferably implemented slowly.

In one version, the measured threshold voltage is added to the desired data voltage for the respective pixels, either in the analogue or digital domains, for example in the source driver circuit (digitally) or in the pixels themselves (analogue). In this way, the pixel drive signals for the plurality of display pixels are modified in response to the measured threshold voltage of the dummy drive transistor threshold voltage. A further alternative is to offset the column voltage range compared to the other voltages. This is an analogue technique, carried out externally.

Figure 9:
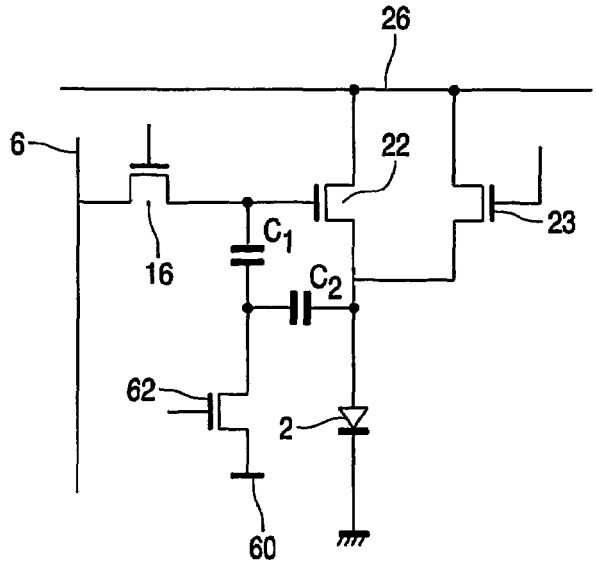
FIG. 9 shows a pixel circuit for in-pixel addition of a compensation voltage.

FIG. 9 shows a first pixel arrangement which enables the threshold voltage to be added within the pixels.

First and second capacitors $C_1$ and $C_2$ are connected in series between the gate and source of the drive transistor 22. The data input to the pixel is provided to the drive transistor gate by means of the address transistor 16. This data input charges the first capacitor $C_1$ to the pixel data voltage. The second capacitor $C_2$ is for storing the drive transistor threshold voltage (as determined by the dummy pixel arrangement).

The junction between the first and second capacitors is connected to an additional line 60 through a third transistor 62. This additional line 60 is for providing the threshold voltage to the pixel.

Figure 10:
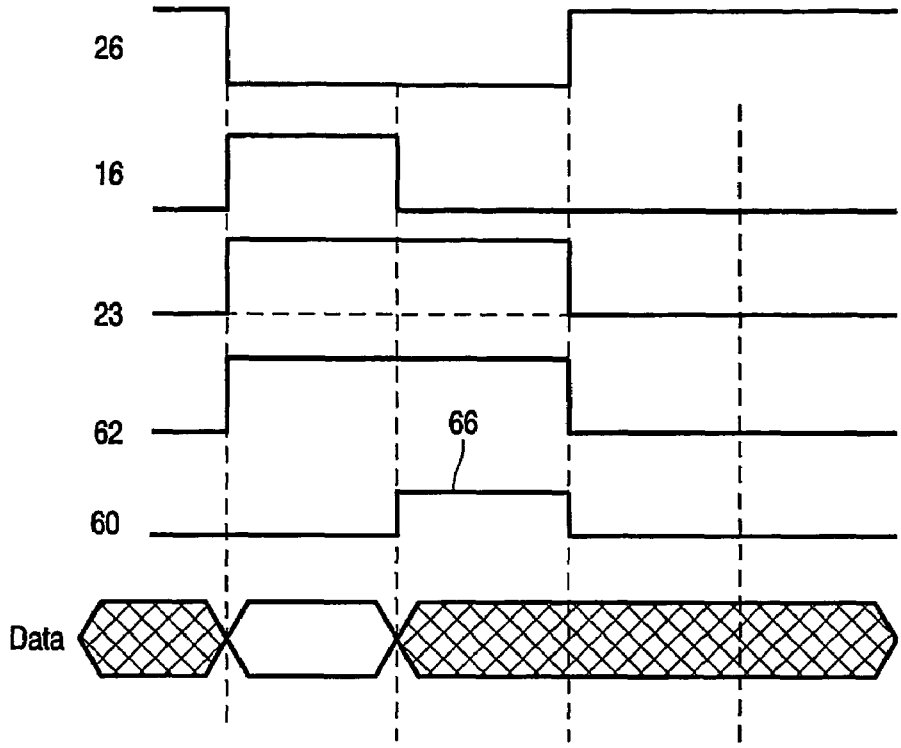
FIG. 10 is a timing diagram to explain the operation of the circuit of FIG. 9.

Only the drive transistor 22 is used in constant current mode. All other TFTs 16, 23, 62 in the circuit are used as switches that operate on a short duty cycle. Therefore, the threshold voltage drift in these devices is small and does not affect the circuit performance. The timing diagram is shown in FIG. 10, for the application of one pixel signal with threshold compensation (i.e. one address pulse only). The timing of application of the "second mode data" is not shown, and it will be apparent to those skilled in the art how this can be implemented.

The plots 16, 23, 62, represent the gate voltages applied to the respective transistors. Plot 60 represents the voltage applied to the additional line 60, and the clear part of the plot "DATA" represents the timing of the data signal on the data line 6. The hatched area represents the time when data on the data line 6 is for other rows of pixels. It will become apparent from the description below that data for other rows of pixels can be applied during this time so that data is almost continuously applied to the data line, giving a pipelined operation.

The circuit operation is to store the data voltage $C_1$, and then store the threshold voltage on $C_2$ so that the gate-source of the drive transistor 22 is the data voltage plus the threshold voltage.

The circuit operation comprises the following steps.

The address transistor 16 and the second drive transistor 23 are turned on, and the third transistor 62 is turned on. During this time, a ground voltage is provided on the line 60 as shown in plot 60. This connects one side of the capacitor $C_1$ to ground and connects the other side to the data voltage, so that the data voltage is stored on $C_1$.

The address transistor 16 is then turned off so that the capacitor $C_1$ is floating. The threshold voltage 66 is then provided on line 60 and this charges the second capacitor $C_2$, the opposite terminal of which is connected to ground through the second address transistor 23 (because the power supply line 26 is low).

Finally, the transistors 62 and 23 are turned off, the power goes high, and the drive transistor has the combined voltages of the two capacitors applied across its gate-source junction.

FIG. 10 shows that the data only needs to be on the column 6 for a period of time corresponding to the row address pulse for the address transistor 16. The second half of the addressing phase can overlap the first half of the addressing phase for an adjacent row, so that a pipelined address sequence can be used. Thus, the length of the addressing sequence does not imply long pixel programming times, and the effective line time is only limited by the time required to charge the capacitor $C_1$ when the address transistor is on. This time period is the same as for a standard active matrix addressing sequence.

Figure 11:
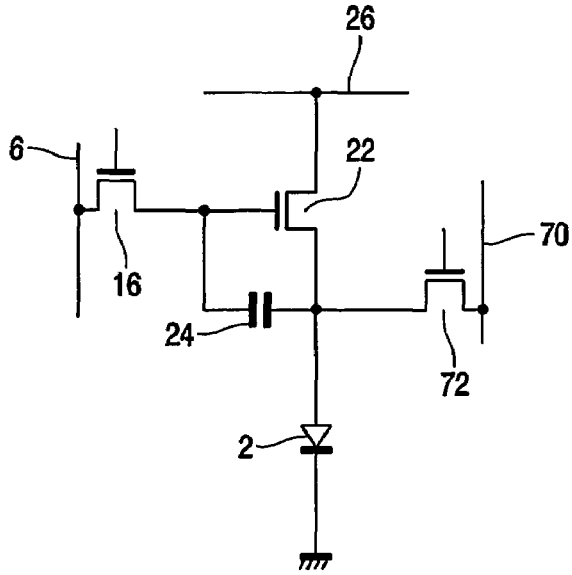
FIG. 11 shows a second pixel circuit for in-pixel addition of a compensation voltage.

FIG. 11 shows a second pixel arrangement which allows the threshold voltage to be added within the pixels. The circuit of FIG. 11 is essentially the same as the dummy pixel circuit of FIG. 7, but the sense line 40 is replaced with an additional input line 70 and the sense transistor 42 is replaced with an additional input transistor 72. This pixel is driven by charging one side of the storage capacitor 24 to the data voltage, and charging the other side of the storage capacitor 24 to a negative voltage equal in magnitude to the threshold voltage. Thus, the total voltage on the storage capacitor is the data voltage added to the threshold voltage.

Figure 12:
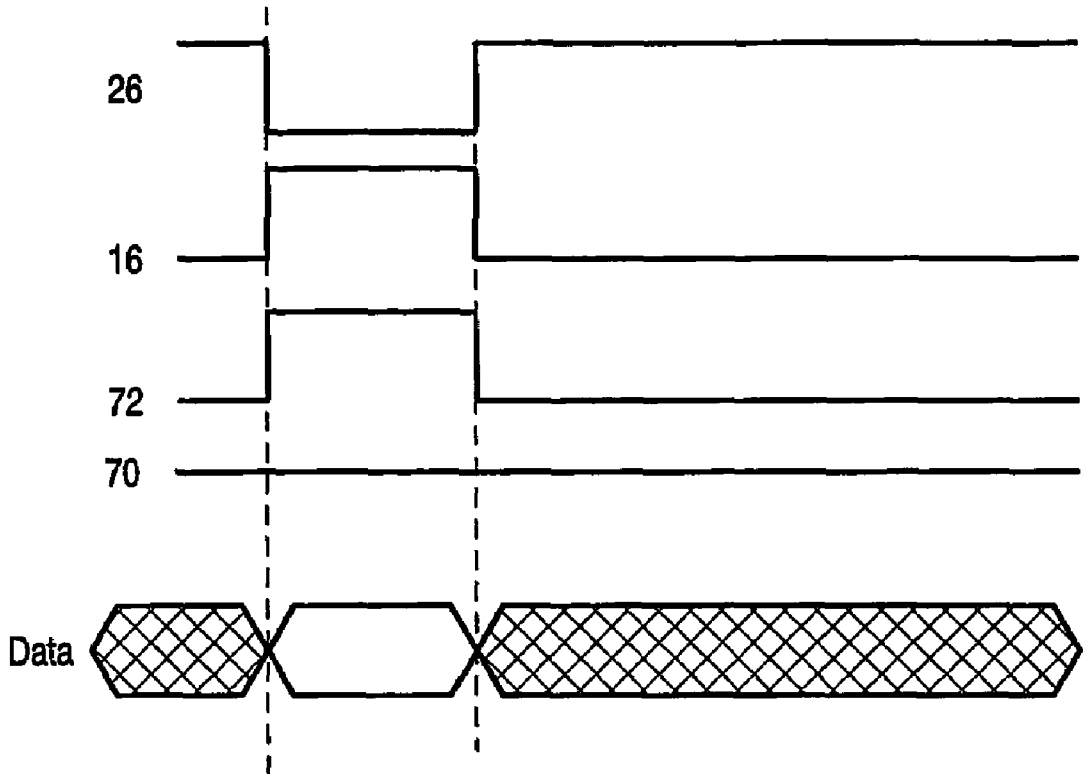
FIG. 12 is a timing diagram to explain the operation of the circuit of FIG. 11.

FIG. 12 shows the timing of operation. The addressing period has only one phase. The inverse of the threshold voltage is provided on the line input line 70, and the transistor 72 supplies this voltage to one terminal of the capacitor 24. The data voltage is provided to the other terminal of the capacitor 24 through the address transistor 16. The voltage across the capacitor is thus the sum of the data voltage and the threshold voltage. The second drive transistor 23 of previous circuits is not required, and the role of the second drive transistor 23 can be performed by the transistor 72.

At the end of pixel programming, the transistor 72 is turned off and the display element turns on. The anode reaches an equilibrium voltage, and the desired gate-source voltage is held on the capacitor 24.

Again, FIG. 12 shows the timing only for the loading of pixel data for driving the display. For addressing the drive transistor with the "second mode data" the power supply line remains low to turn off the display element.

In the two examples above, the pixel is modified to allow addition of the threshold voltage. This enables the voltages required on the column conductors to be kept within limits, as the addition takes place in the pixel. The threshold voltage may alternatively be added to the pixel drive signal by a capacitive coupling effect, for example in a similar manner to the addition of voltages in the so-called "4 level drive scheme" used with active matrix liquid crystal displays.

As a further alternative, the compensation may be carried out by varying the power supply line voltage in order to alter the display element brightness for a given data input.

As described above, the gate-source voltage for the second mode (when the display element is turned off) is calculated to provide fixed ageing of each drive transistor within each field period.

The drift of the threshold voltage of the drive transistor has been found to obey the equation:

$$V_t(t)=V_t(t=0)+k(V_g-V_t(t))^a(vt)^b \tag{1}$$

Where:

$V_t(t)$ is the threshold voltage at time t, k is a constant that depends on the deposition conditions of the amorphous silicon, $V_g$ is the gate voltage on the drive transistor, a is a constant depending on the amorphous silicon (typically 1.7 for good quality a-Si), v is a constant for all a-Si ($\sim 10^{10}$ Hz), and $b=T/T_0$, where T is the absolute temperature and $T_0$ depends on the quality of the amorphous silicon (typically 720K).

The drift rate is non-linear in gate voltage and in time, as can be seen from equation (1). The drift rate is slow compared to the frame time of the display, so that for the drift within a single frame time, we can ignore the time dependence of $V_t$ and derive the equation:

$$\delta V_t=k(V_g-V_t)^a \tag{2}$$

Where $\delta V_t$ is the threshold voltage drift caused within a single frame. The drive level of the TFT in the period where the LED is not illuminated is chosen so that the two drifts sum to the same amount for all pixels, i.e.

$$\delta V_{ton}+\delta V_{toff}=k(V_{gwc}-V_t)^a \tag{3}$$

$V_{gwc}$ is the worst case gate drive condition (maximum brightness). Thus, assuming equal time periods for the on and off drive states, the off state drive condition can be found to be:

$$V_{goff} = V_t + ((V_{gwc} - V_t)^a - (V_{gon} - V_t)^a)^{\frac{1}{a}} \tag{4}$$

This equation can thus be used to determine the gate-source voltage during the off period.

If this scheme is followed, the threshold voltage of all devices will drift in the same way, and as discussed above, this uniform drift can be sensed by a test device located on the display edge. This provides the value of $V_t$ for use in equation (4) above.

It is not necessary that the on and off times are equal, but the equations become more complicated if they are not. Lower than 50% LED duty cycles can be achieved by either introducing a third period where the drive TFT is turned off (gate voltage below threshold), or by manipulation of the LED power supply connections during the time when the gate of the drive transistor is in the on state.

Due to the equations of drift, if a small error exists in the gate drive voltages (e.g. quantisation error) or a small variation of the initial threshold voltages exists, then the errors are reduced with time, so that the method is robust and does not require an expensive degree of accuracy.

As described above, the correction enables compensation of the ageing of the pixel circuit components, in particular the drive transistor. The compensation circuit and method also provides compensation for temperature variations of the display. The characteristics of amorphous silicon circuits are temperature dependent, and the compensation circuit which can be used in this invention can compensate for this temperature dependency by placing the dummy pixel circuits in an area which is subjected to similar temperature conditions as the pixels of the display. In this way, the temperature in the vicinity of the dummy pixel circuits is representative of the temperature of the active pixel area.

Circuits have been shown using only n-type transistors. A number of technologies are possible, for example crystalline silicon, hydrogenated amorphous silicon, polysilicon and even semiconducting polymers. These are all intended to be within the scope of the invention as claimed. The display devices may be polymer LED devices, organic LED devices, phosphor containing materials and other light emitting structures.

There are other ways of implementing in-pixel addition of voltages, and there are also numerous ways of implementing changes to the pixel drive signals before they are provided to the columns, for illuminating conventional pixel designs. The various data processing techniques for implementing the modification of the data in the column driver circuitry has not been described in detail as this will be routine to those skilled in the art.

In the examples above, an average illumination value is used as the basis of the correction signal. It will be apparent to those skilled in the art that a more complicated scheme may be employed for determining the required correction. This may, for example, take account not only of the average illumination but also the variance in the illumination values, or indeed other statistical parameters.

It is possible for a single correction signal to be applied to the entire array. However, the correction may be row-by-row, or even on the basis of block areas of the pixel array. This may depend on the nature of the data intended to be displayed by the device.

Various other modifications will be apparent to those skilled in the art.

The invention claimed is:

1. An active matrix display device comprising an array of display pixels, each pixel (1) comprising a current-driven light emitting display element (2) and a drive transistor (22) for driving a current through the display element (2) wherein each pixel is operable in two modes; a first mode in which the drive transistor current is supplied to the display element (2) and is selected to provide a desired pixel brightness, and a second mode in which a voltage is provided to the drive transistor (22) and is selected to provide a desired ageing effect, and no current flows through the display element (2); and wherein said first and second modes are carried out for each addressing of each pixel.

2. A device as claimed in claim 1, wherein the voltage provided to the drive transistor in the second mode is a gate-source voltage.

3. A device as claimed in claim 1, wherein each pixel is operated in the two modes for each frame of image data.

4. A device as claimed in claim 1, wherein the drive transistor (22) and the display element (2) are connected in series between a high power supply line (26) and a low power supply line.

5. A device as claimed in claim 4, wherein the voltage on the high power supply line (26) is switchable so that different voltages are applied to the high power supply line for the two modes of operation.

6. A device as claimed in claim 4, wherein a second drive transistor (23) is provided in parallel with the drive transistor (22) for selectively bypassing the display element.

7. A device as claimed in claim 6, further comprising an address transistor (16) between a data supply line (6) and the gate of the drive transistor (22).

8. A device as claimed in claim 7, wherein the address transistor (16) and the second drive transistor (23) are controlled by a shared control line.

9. A device as claimed in claim 1, wherein the display pixels are within a display area (30), and wherein the device further comprises at least one modelling circuit (32) outside the display area for modelling the behaviour of a plurality of the display pixels and comprising a current-driven light emitting display element and a drive transistor, the at least one modelling circuit being provided with a pixel drive signal derived from the pixel drive signals for the plurality of display pixels, wherein the device further comprises:

means (50,52,54) for measuring a transistor characteristic of the drive transistor of the modelling circuit; and means for modifying the pixel drive signals for the plurality of display pixels in response to the measured transistor characteristic.

10. A device as claimed in claim 9, wherein a single modelling circuit (32) is for modelling the behaviour of all of the display pixels.

11. A device as claimed in claim 9, wherein the modelling circuit (32) comprises a scaled version of a pixel circuit of the display.

12. A device as claimed in claim 9 further comprising column driver circuitry (9) providing analogue output voltages for driving the pixels of the array, and wherein the means for modifying the pixel drive signals for the plurality of display pixels modifies the analogue output of the column driver circuitry.

13. A device as claimed in claim 9, wherein the means for modifying the pixel drive signals for the plurality of display pixels comprises additional circuitry within each display pixel.

14. A method of driving an active matrix display device comprising an array of display pixels, each pixel comprising a current-driven light emitting display element (2) and a drive transistor (22) for driving a current through the display element, the method comprising:

in a first mode, providing a first gate-source voltage to the drive transistor and supplying the resulting current to the display element (2); and in a second mode, providing a second gate source voltage to the drive transistor, the second gate source voltage being selected to provide a desired ageing effect, and wherein no current flows through the display element (2) during the second mode; and wherein said first and second modes are carried out for each addressing of each pixel.

15. A method as claimed in claim 14, wherein the second mode is carried out before the first mode.

16. A method as claimed in claim 15, wherein the second mode immediately precedes an addressing phase during which the first gate source voltage is provided to the drive transistor.

17. A method as claimed in claim 14, further comprising providing at least one modelling circuit (32) outside the display area (30) for modelling the behaviour of a plurality of the display pixels and comprising a current-driven light emitting display element and a drive transistor;

providing the at least one modelling circuit being with a pixel drive signal derived from the pixel drive signals for the plurality of display pixels;

measuring a transistor characteristic of the drive transistor of the modelling circuit; and modifying the pixel drive signals for the plurality of display pixels in response to the measured transistor characteristic.

18. A method as claimed in claim 17, wherein the transistor characteristic comprises the threshold voltage.

19. A method as claimed in claim 17, wherein a single modelling circuit is used for modelling the behaviour of all of the display pixels.

* * * * *